United States Patent [19]

Reifel

[11] Patent Number: 4,709,753

[45] Date of Patent: Dec. 1, 1987

[54] UNI-DIRECTIONAL FIN-AND-TUBE HEAT EXCHANGER

[75] Inventor: Allan J. Reifel, Florissant, Mo.

[73] Assignee: Nordyne, Inc., St. Louis, Mo.

[21] Appl. No.: 904,406

[22] Filed: Sep. 8, 1986

[51] Int. Cl.[4] ..... F24B 1/06

[52] U.S. Cl. ..... 165/125; 165/151; 165/182

[58] Field of Search ..... 165/151, 125, 182

[56] References Cited

U.S. PATENT DOCUMENTS

| | | | |
|---|---|---|---|
| 2,023,739 | 12/1935 | Mason | 165/151 X |
| 2,532,301 | 12/1950 | Hayward | 165/151 X |
| 2,610,484 | 9/1952 | Lange | 165/125 X |
| 3,438,433 | 4/1969 | Gunter | 165/151 |
| 3,478,821 | 11/1969 | Fieni | 165/151 X |

FOREIGN PATENT DOCUMENTS

| | | | |
|---|---|---|---|
| 1521499 | 3/1967 | France | 165/151 |

*Primary Examiner*—Albert W. Davis, Jr.
*Assistant Examiner*—Peggy Neils
*Attorney, Agent, or Firm*—Jerome A. Gross

[57] ABSTRACT

A fin-and-tube heat exchanger designed for one-way airflow, in which louvers, formed from the fin stock, progressively increase in length from the fin leading edge to its trailing edge. Their end walls channel air into stagnant air spaces behind the tubes. The tube collars may be offset somewhat toward the fin trailing edge, further reducing the stagnant air zones. In those bent heat exchangers in which air flows in from outside the curve, offsetting the collars also lessens the angular convergence of fin trailing edges inside the curve and presents less resistance to airflow.

10 Claims, 4 Drawing Figures

UNI-DIRECTIONAL FIN-AND-TUBE HEAT EXCHANGER

FIELD OF THE INVENTION

This invention relates to improvements in fin-and-tube heat exchangers, and in particular, to those curved condenser units for air conditioners which are designed for inflow of air from outside of the curve.

DESCRIPTION OF THE PRIOR ART

Heat exchangers, such as the type used in air conditioners for vans, mobile homes, boats, etc. are typically made from one or more rows of linearly aligned tubes about which closely spaced fins are mounted perpendicular to the tubes. Providing the spacing between the fins are integral tube-receiving collars corresponding in alignment and number to the tubes.

In conventional systems inflowing air is divided to flow along both sides of a tube; but on the tube aft side, the air does not follow the configuration of the tube; instead it meets at some point downstream. This leaves a zone immediately aft of each tube collar in which the air is substantially stagnant or circulates in eddies without immediately flowing downstream. Such air affords little heat transfer.

To improve heat exchange efficiency of these assemblies, the flat surfaces of the fins are conventionally interrupted to break up the airflow. These surface interruptions may take the form of louvers or lances displaced from the plane of the fin or other similar interruptions to or displacements from the plane surface.

At least one prior inventor has sought to use such displaced portions to direct airflow into the stagnant air zones behind the tubes; see U.S. Pat. No. 3,397,741 dated Aug. 20, 1968, assigned to Hudson Engineering Corp. That inventor, designing a heat exchanger with more than one row of tubes, determined upon a pattern of varying length louvers which is symmetrical about lines connecting the centers of each of several rows of tubes; both forward and aft of these lines the louvers attain a length greater than the tube spacing. His patent contemplated that the end walls of those louvers which are located aft of such lines connecting the tube centers (regardless which direction of airflow was decided upon) would direct part of the airflow into the otherwise stagnant air spaces behind the tubes. If applied to a heat exchanger having only a single row of tubes, such symmetrical louver arrangement would fail to achieve optimum efficiency; because those long louvers near the leading edge would act as a partial barrier to the inflow of air along the sides of the tubes.

Another type of fin surface area which is displaced for better efficiency are lances; unlike the angularly bent louvers, in lances, portions between adjacent parallel slits are displaced parallel to the original plane of the fin; they may be displaced to either side of its plane.

A particular problem in those single-row heat exchangers in which the tubes are bent to a relatively small radius of curvature, is the angular convergence of the fin trailing edges on the inside of the curve. This convergence may seriously restrict air flowing in from outside the curve. The Applicant has no knowledge of heat exchanger fin design which specifically addresses this problem.

SUMMARY OF THE INVENTION

Among the objectives of the present invention are to minimize the zones or spaces of stagnant air behind the tubes thus to provide optimal heat transfer, and to lessen the effect of angular convergence of fins in curved portions of single-row, bent heat exchangers.

To carry out these objectives the fins of the present invention are designed for one way airflow only. I utilize portions displaced to one side of the plane of the fins, preferably louvers which progressively increase in length, with the shortest louver near the leading edge of the fin and the longest near the trailing edge. The slanting progression of louver end walls, starting well forward of the line connecting the tube centers, channels at least part of air flowing in over a broad portion of the leading edge, into the stagnant air zones behind and blanketed by the collars.

To further reduce the fin area so occupied by stagnant air, the tube collars may be offset somewhat toward the fin trailing edge; the lesser fin area behind the collars is compensated by greater area forward of the collars. This offset toward the trailing edge is of particular advantage when used in a heat exchanger bent to a relatively small radius of curvature in which the inflow of air is from outside the curve. The decreased length between the tubes and the trailing edges lessens the convergence of the trailing edges inside the curve. Bends in the heat exchanger thus offer less restriction to airflow.

DESCRIPTION OF THE PREFERRED EMBODIMENT

Figure 1:
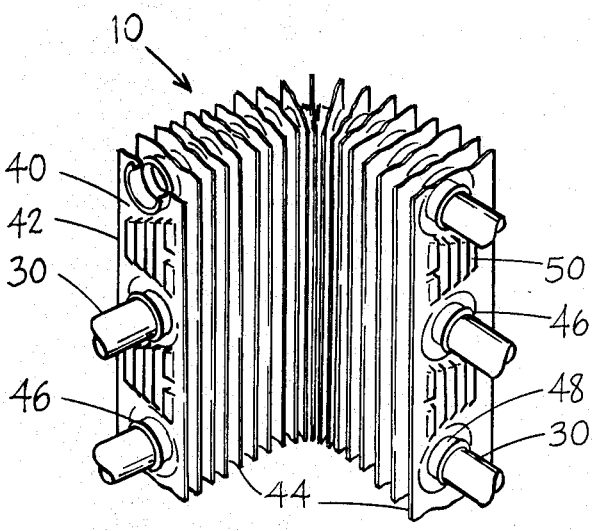
FIG. 1 is a perspective view of a bent portion of a fin-and-tube heat exchanger, showing the convergence of fin trailing edges on the inside of the curved portion.

The heat exchanger of the present invention, generally designated 10 and shown in FIG. 1, includes a single row of linearly-aligned ductile tubes 30 about which a plurality of closely-spaced fins 40 are mounted perpendicular to the tubes 30.

The fins 40 are made from a ribbon-like fin stock, preferably of aluminum or other ductile metal characterized by a comparable coefficient of thermal conductivity. Its thickness may vary depending upon the particular use to which the heat exchanger will be put.

The fins 40 have a special design of portions displaced from their plane, which pattern serves to distinguish their leading and trailing edges 42, 44 from each other. Along a line between these edges 42, 44 are circular collars 46 drawn from the plane of the fin 40. The spacing of these collars 46 from each other prescribes the parallel alignment of the single row of tubes 30 drawn through them. The height of the collar walls 48 determines the spacing of the mounted fins 40 from each other in an assembled heat exchanger 10.

Figure 2:
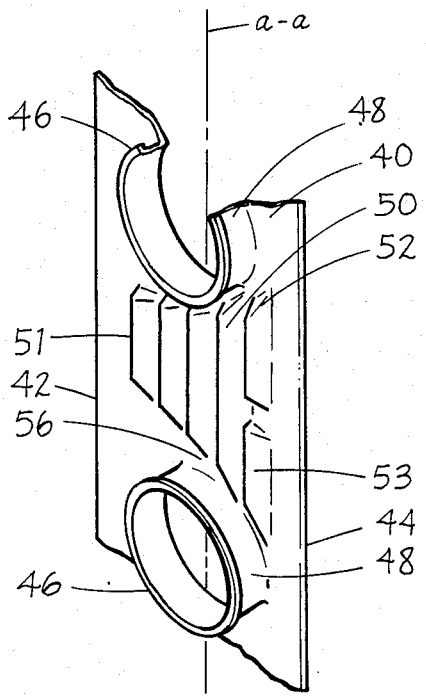
FIG. 2 is an enlarged perspective view of a portion of one of the fins of FIG. 1.
Figure 3:
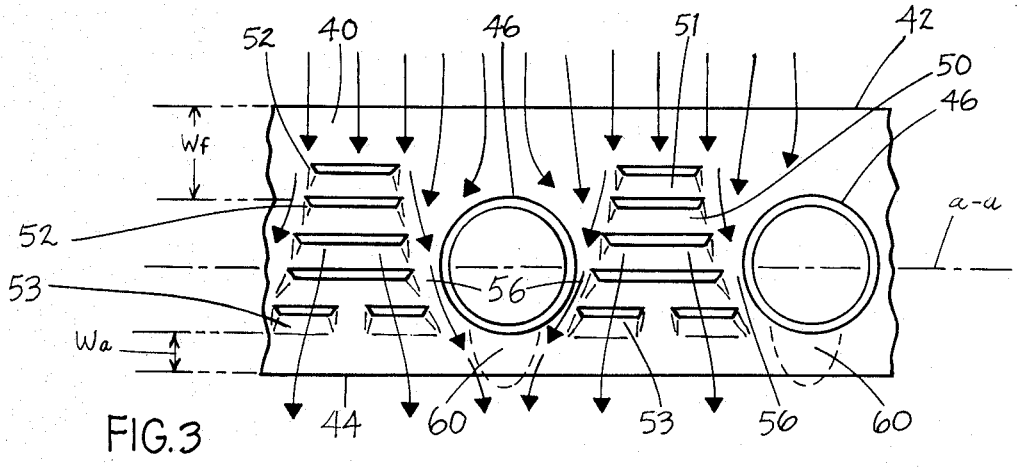
FIG. 3 is a fragmentary view somewhat schematic of a portion of a fin having louvers of progressively increasing length and tube collars offset aft of a centerline between the fin edges. Phantom lines show areas of stagnant airflow behind the collars.

On the fin surface area between adjacent collars 46 are a plurality of longitudinal louvers 50, slitted and bent from the plane of the fin 40 and open adjacent to the leading edge 42, as shown in FIGS. 2 and 3. The length of these louvers 50 increases progressively with the shortest louver 51 being nearest the leading edge 42 of the fin 40 and of a length substantially less than the distance between adjacent collar walls 48. The longest louver 53 (which, to avoid distortion, may be formed in two linearly adjacent parts as shown) is on the opposite side of a line a—a connecting the centers of the collars 46; its total length is at least substantially equal to the spacing, along line a—a, of adjacent collar walls 48 from each other. The end walls 52 of the louvers 50 are drawn from the plane of the fin 40 at angles of about 45° or greater; they cooperate with the collar walls 48 to define channels 56.

Figure 4:
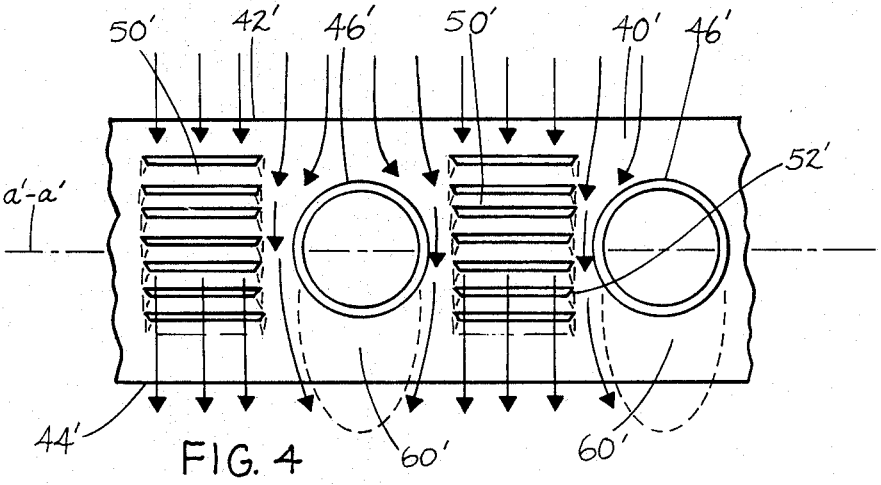
FIG. 4 is a contrasting fragmentary view of a conventional fin portion, whose tube collars are centered between the fin edges and whose louvers are of equal length. Phantom lines show the greater areas of stagnant airflow behind the collars.

Before describing the unique effect of the louver pattern shown in FIG. 3, its construction is to be contrasted with the conventional louver arrangement shown in FIG. 4. The fin portion 40' there shown has been used regardless of the direction of airflow. It has collars 46' spaced equie-distant between leading and trailing edges 42', 44'; and has sets of louvers 50' of equal length, all substantially shorter than the spacing between the collars 46'. While on the leading edge 42' side of the collars 46' the airflow, shown schematically by arrows, divides closely in advance of the collars 46', it does not re-form immediately at the aft side of these collars 46', but leaves a stagnant air zone 60' roughly as shown. The result is, in effect, to waste a significant part of the fin area.

In the present invention this waste is minimized. The progression of adjacent end walls 52, on the sets of louvers 50 on both sides of a collar 46 (as seen in FIG. 3), in effect gathers a broad width of inflowing air and causes it to converge in channels 56 on both sides of and toward the rear of the collars 46. This convergence behind the collar walls 48 effectively reduces the size of zones of stagnant air to the smaller zones 60 shown in FIG. 3.

A further reduction of such waste of fin area may be attained by offsetting the centerline a—a of the tube-receiving collars 46 somewhat toward the trailing edge 44. As seen in FIG. 3, the fin width $W_a$ aft of the collar walls 48, some of which is wasted in the stagnant zones 60, is reduced to increase the width $W_f$ forward of the collar forward walls, where all area is useful for heat transfer. As a practical limit, the aft width $W_a$ should preferably be no less than half the forward width $W_f$.

In the curved heat exchanger 10 of FIG. 1, designed for inflow of air from the outer side of the curve, two additional advantages are achieved by offsetting the tube collars 46 toward the trailing edge 44. The single row of parallel tubes 30 is bent to an arc common to all the tubes, so that their trailing edges 44 are inside the curve of the arc. When tubes 30 are bent against a curved mandrel by applying a relatively distributed force, on the outside of the curve, the resisting force of the mandrel may bend the fin trailing edges 44; such bending is less likely, and less severe, when the fin edges are shorter. Even if the fins are strong enough to withstand such bending, the angular convergence of the trailing edges 44 on the inside of the curve, as seen in FIG. 1, may severely constrict the airflow; such constriction is lessened when the fin edges are shorter, as with the lesser width $W_a$; this increases the spacing of adjacent trailing edges 44 from each other.

As various modifications may be made in the constructions herein described and illustrated without departing from the scope of the invention, it is intended that all matter contained in the foregoing description or shown in the accompanying drawings shall be interpreted as illustrative rather than limiting.

What is claimed:

1. For exchanging heat between liquid and air, a uni-directional fin-and-tube heat exchanger having a curved portion and being of the type in which air flows in from the outside of the curve, comprising a single row of linearly-aligned ductile tubes of circular cross-section for conducting such liquid, in combination with a plurality of fins formed from originally planar ribbon-like fin stock and having parallel leading and trailing edges between which air flows generally aft, further having circular collars spacedly between edges drawn from the original plane of said fin stock, whereby to accept said tubes perpendicular to the fins, there being, in each fin stock area defined by the spacing of the tube centers from each other, a plurality of longitudinal louvers bent from the plane of said fin stock toward one side only thereof, and open adjacent to the leading edge, whose length increases progressively between said edges from a length substantially less than the distance of the nearest collar walls from each other, to a length at least substantially equal to the such distance, each louver being supported by louver end walls formed from such plane and spaced from said collars, whereby a greater portion of the air inflowing along the leading edge at each side of a collar is channeled convergingly by the louver end walls into otherwise stagnant air spaces along the fin stock behind the collars, the said collars being offset aft of a centerline between the leading and trailing edges and inward of the trailing edge of said fin stock, whereby to decrease their distance from the trailing edges of the fins, such heat exchanger curved portion being formed by said tubes being bent to such an arc, common to all said tubes, that the trailing edges of said fins are inside the curve of the arc, whereby the decreased distance from the collars to the fin trailing edges increases the spacing of adjacent trailing edges from each other, thereby lessening the resistance to airflow from angular convergence of the fins, and the extent of such otherwise stagnant air spaces along the fin stock behind the collars may be somewhat lessened.

2. A uni-directional fin-and-tube heat exchanger as defined in claim 1, in which the amount of such offset is such that the width of fin surface behind the collar wall is reduced to no less than half such width forward of the collar wall.

3. For exchanging heat between liquid and air, a uni-directional fin-and-tube heat exchanger comprising a row of linearly-aligned tubes of circular cross-section for conducting such liquid, in combination with a plurality of fins from originally planar fin stock, and having parallel leading and trailing edges between which air flows generally aft, further having circular collars spacedly between said edges drawn from the original plane of said fin stock, whereby to accept said tubes perpendicular to the fins, there being, in each fin stock area defined by the spacing of the tube centers from each other, a plurality of longitudinal louvers bent from the plane of said fin stock toward one side only thereof, and open adjacent to the leading edge, whose length increases progressively between said edges, from a length substantially less than the distance of the nearest collar walls from each other, to a length at least substantially equal to such distance, each louver being supported by louver end walls formed from such plane and spaced from said collars, whereby a greater portion of the air inflowing along the leading edge at each side of a collar is channeled converging by the louver end walls into the otherwise stagnant air spaces along the fin stock behind the collars.

4. A uni-directional fin-and-tube heat exchanger as defined in claim 3, in which said row of linearly-aligned tubes is a single row of tubes, said collars being offset aft of a centerline between the leading and trailing edges and inward of the trailing edge of said fin stock, whereby to decrease their distance from the trailing edges of the fins.

5. A uni-directional fin-and-tube heat exchanger, as defined in claim 4, the heat exchanger having a curved portion and being of the type in which air flows in from the outside of the curve, said tubes being ductile, said heat exchanger curved portion being formed by said tubes being bent to such an arc, common to all said tubes, that the trailing edges of said fins are inside the curve of the arc, whereby the decreased distance from the tubes to the fin trailing edges increases the spacing of adjacent trailing edges from each other, thereby lessening the resistance to airflow from the angular convergence of the fins.

6. A uni-directional fin-and-tube heat exchanger as defined in claim 4, in which the amount of such offset is such that the width of fin surface behind the collar wall is reduced to no less than half such width forward of the collar wall.

7. For use in constructing fin-and-tube heat exchangers of the type in which air flows across fins in one design direction only, the invention comprising generally planar ribbon-like fin stock having parallel leading and trailing edges, and including tube-receiving circular collars spacedly between said edges and drawn from the plane of said fin stock, said collars being positioned along a line between said leading and trailing edges, said fin stock further having a plurality of portions, in each fin stock area defined by the spacing of the tube centers from each other, which portions are displaced from the plane toward one side only thereof, and open adjacent to said leading edge, the length of said displaced portions increasing progressively between the said edges for a length substantially less than the distance of the nearest collar walls from each other, to a length at least substantially equal to such distance, each said displaced portion being supported by end walls formed from such plane and spaced from said collars, whereby on assembly of a plurality of fins, made from fin stock so formed, with tubes extending through said collars, and on flow of air therethrough at each side of a collar, the end walls of said displaced portions channel the flow of air convergingly into otherwise stagnant air spaces along the fin stock behind the collars.

8. The fin stock defined in claim 7, wherein said outwardly displaced portions are longitudinal louvers bent from the plane of said fin stock toward one side only thereof.

9. The fin stock defined in claim 7, wherein the collars are offset aft of such line between the leading and trailing edges and inward of the trailing edge, whereby to decrease their distance from the trailing edges of the fin stock.

10. The fin stock defined in claim 9, in which the amount of such offset is such that the width of fin surface behind the collar wall is reduced to no less than half such width forward of the collar wall.

* * * * *

UNITED STATES PATENT AND TRADEMARK OFFICE

CERTIFICATE OF CORRECTION

PATENT NO. : 4,709,753

DATED : December 1, 1987

INVENTOR(S) : Allan J. Reifel

It is certified that error appears in the above-identified patent and that said Letters Patent is hereby corrected as shown below:

In Column 3, line 25, delete "equie-distant" and substitute ---equi-distant---.

In Column 4, line 21, insert ---said--- between the words "between" and edges".

In Column 5, line 18, delete "converging" and substitute ---convergingly---.

In Column 6, line 19, delete "for" and substitute ---from---.

Signed and Sealed this

Seventeenth Day of May, 1988

*Attest:*

*Attesting Officer*

DONALD J. QUIGG

*Commissioner of Patents and Trademarks*